US008024829B2

(12) United States Patent
Carr et al.

(10) Patent No.: US 8,024,829 B2
(45) Date of Patent: Sep. 27, 2011

(54) WEIGHT ACTIVATED RESTRAINING PILLOW

(76) Inventors: Mia Carr, Lindstrom, MN (US); Loretta E. Carr, Roseville, MN (US)

( * ) Notice: Subject to any disclaimer, the term of this patent is extended or adjusted under 35 U.S.C. 154(b) by 79 days.

(21) Appl. No.: 12/322,695

(22) Filed: Feb. 5, 2009

(65) Prior Publication Data

US 2009/0193589 A1 Aug. 6, 2009

Related U.S. Application Data

(60) Provisional application No. 61/063,632, filed on Feb. 5, 2008.

(51) Int. Cl.
*A47G 9/00* (2006.01)

(52) U.S. Cl. ..... 5/655; 5/652

(58) Field of Classification Search ..... 5/655, 652, 5/636–639, 630

See application file for complete search history.

(56) References Cited

U.S. PATENT DOCUMENTS

| | | | | |
|---|---|---|---|---|
| 3,400,413 | A | 9/1968 | Grossa | |
| 4,383,713 | A | 5/1983 | Roston | |
| D282,427 | S | 2/1986 | O'Sullivan | |
| D298,198 | S | 10/1988 | O'Sullivant | |
| 4,788,726 | A * | 12/1988 | Rafalko | 5/93.1 |
| 5,261,134 | A | 11/1993 | Matthews | |
| 5,279,237 | A | 1/1994 | Alivizatos | |
| 5,661,861 | A | 9/1997 | Matthews | |
| 6,279,185 | B1 | 8/2001 | Matthews | |
| 6,412,128 | B1 | 7/2002 | Matthews | |
| 6,640,977 | B2 | 11/2003 | Matthews Brown et al. | |
| 6,685,024 | B1 | 2/2004 | Matthews | |
| 6,857,150 | B2 * | 2/2005 | Matthews Brown et al. | 5/655 |
| 7,404,222 | B2 | 7/2008 | Tidwell | |
| D593,351 | S * | 6/2009 | Song | D6/601 |
| 2008/0216752 | A1 | 9/2008 | Song | |

FOREIGN PATENT DOCUMENTS

WO W02007002394 A2 1/2007

* cited by examiner

*Primary Examiner* — Fredrick Conley

(74) *Attorney, Agent, or Firm* — Kinney & Lange, P.A.

(57) ABSTRACT

Weight restraining pillow has a filled outer perimeter area encompassing a central sling area. The sling is defined in part by two generally parallel outer seams adjacent the outer perimeter, and an inner seam located between the outer seams which help hold the fill of the perimeter in place. When a weighted object is placed on the sling, the perimeter is drawn inward toward the object placed therein.

16 Claims, 5 Drawing Sheets

WEIGHT ACTIVATED RESTRAINING PILLOW

CROSS-REFERENCE TO RELATED APPLICATION(S)

This application claims priority to U.S. Provisional Application No. 61/063,632, filed Feb. 5, 2008 and entitled "Weight Activated Restraining Pillow".

BACKGROUND

The present invention relates to pillows or cushions for adults, children, infants, or animals. More specifically, the present invention relates to pillows having peripheral guards for restraining adults, children, infants, or animals.

Pillows have a wide variety of uses. For example, pillows are used almost universally when sleeping to support the head. Pillows may also be used to support other things as well. A variety of cushions, pillows, and pads have been used by both infants and adults which can be conveniently transported and placed on the ground or on a bed to provide a comfortable resting. Because small infants and even toddlers tend to roll off the edge of a bed or other surface without some kind of guard around the periphery, pillows designed especially for use by infants preferably include a raised edge which will block the baby from rolling off the pillow and onto the floor. Rolled up blankets, towels, or pillows are often placed around a small child to prevent the child from falling off a bed unequipped with rails, or similar surface. Traditional adult pillows used singularly are ill suited for such a task and are not recommended for use with babies.

SUMMARY

An embodiment of the present invention is a weight activated restraining pillow including a peripheral cushion area, fill material located within the peripheral cushion area, and a central sling holding area located inside of the peripheral area. The cushion has a top, a bottom, a first side, and a second side. The first side and the second side are substantially parallel and extend between the top and the bottom. The sling is defined in part by a first seam extending substantially parallel to the first side and a second seam extending substantially parallel to the second side. The first seam and the second seam separate the sling from the cushion so that when a weighted object is received into the sling, the first side and the second side of the cushion area draw inward toward the weighted object within the sling.

Another embodiment of the present invention is weight activated restraining pillow including a cushion having a padded region and an unpadded region. The padded region generally surrounds the unpadded region. A first longitudinal seam defines a first side of the unpadded region and a second longitudinal seam defines a second side of the unpadded region. When a weighted object is placed centrally within the unpadded region, it draws the first longitudinal seam and second longitudinal seam inwards toward one another.

DESCRIPTION

Figure 1:
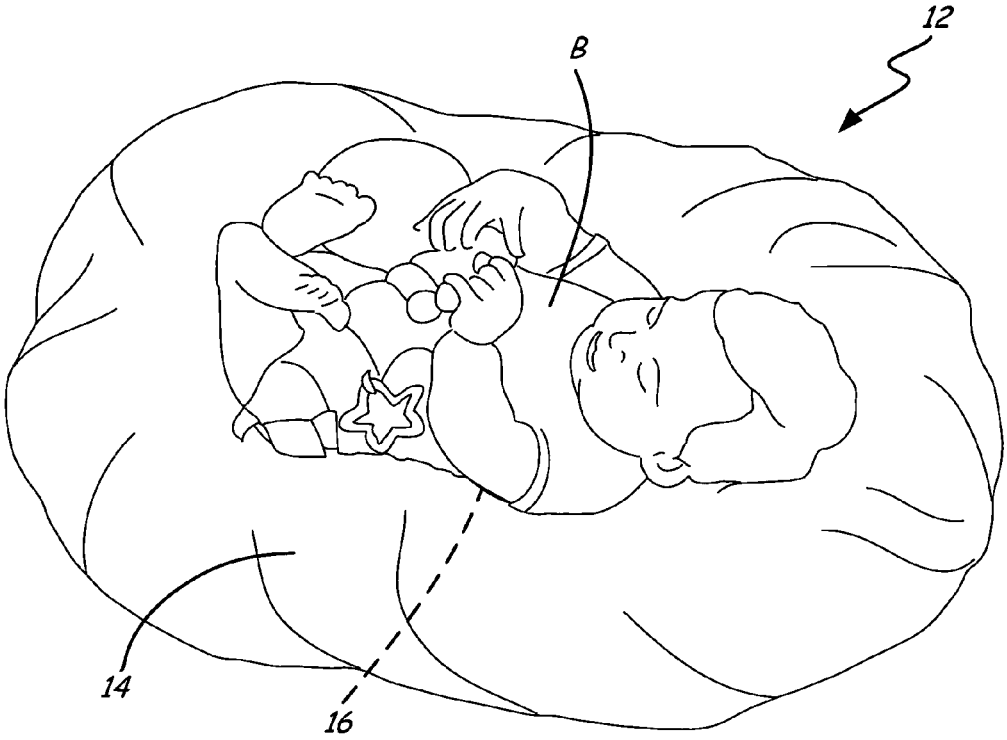
FIG. 1 is a perspective view of a weight activated restraining pillow with an infant placed on its back therein.

FIG. 1 is a perspective view of weight activated restraining pillow 12 with infant B placed on its back therein. Depicted in FIG. 1 are: infant B, pillow 12 having cushion 14 and sling 16. When infant B is placed on its back in sling 16, cushion 14 moves inward such that pillow 12 gently contacts and comforts infant B.

In the embodiment depicted, infant B is lying on its back on top of weight activated restraining pillow 12. Together, peripheral cushion area 14 and central sling area 16 form pillow 12, which can be used as a positioning device and/or a sensory stimulant for infant B. Peripheral cushion area 14 is approximately oval shaped, although the invention is not so limited. In FIG. 1, pillow 12 is sized for an infant such that sling 16 is located mainly beneath infant B and cushion 14 is drawn slightly inward and surrounding infant B. Cushion or padded area 14 is stuffed with fill material such as but not limited to poly fill. In an alternate embodiment, cushion 14 is a vinyl tube that is inflated with air or filled with common pillow contents such as feathers or Styrofoam beads, which may be flame retardant. Sling or unpadded area 16 is not stuffed with fill and therefore, provides a relatively flat holding area for placement of infant B. When infant B is placed on top of pillow 12, the weight of infant B causes sling 16 to deform downwards and cushion 14 to move centrally to contact infant B. As depicted in FIG. 1, pillow 12 promotes spinal alignment of infant B and can also provide physical comfort through light touch of cushion 14 to infant B.

Figure 2:
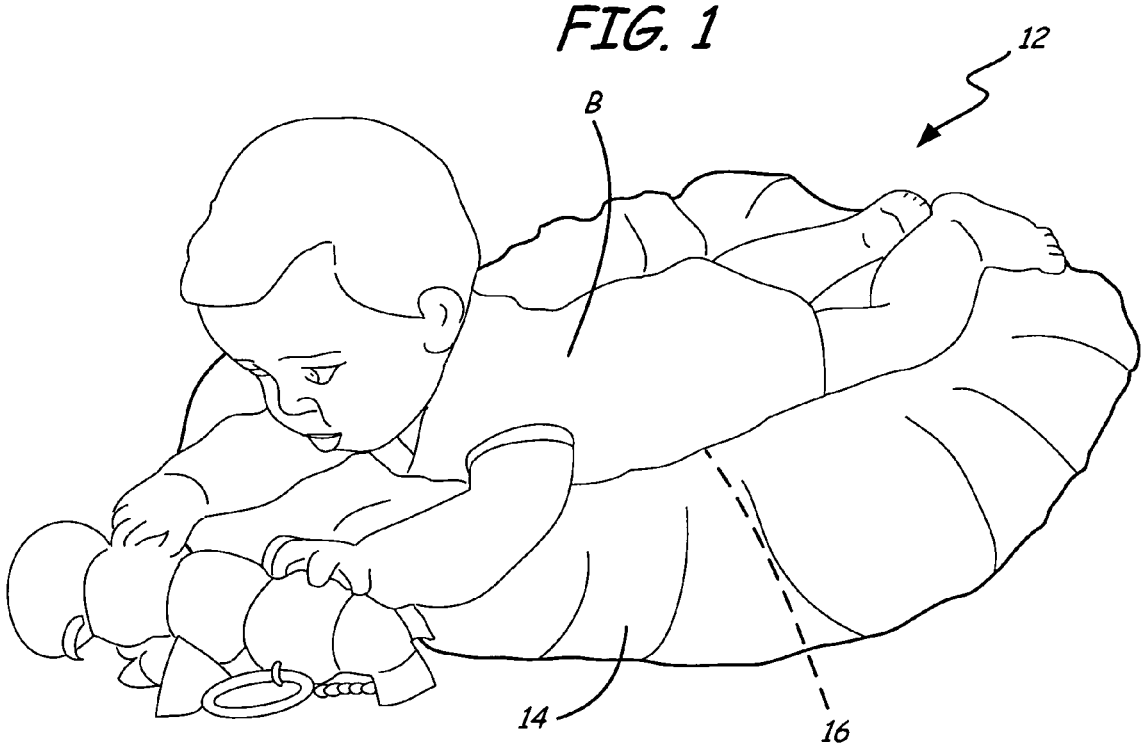
FIG. 2 is a perspective view of a weight activated restraining pillow with an infant placed on its stomach therein.

FIG. 2 is a perspective view of weight activated restraining pillow 12, with infant B placed on its stomach therein. Depicted in FIG. 2 are: infant B, pillow 12, cushion 14 and sling 16. When infant B is placed on its stomach in sling 16, cushion 14 is pulled inwards toward infant B such that pillow 12 gently contacts and comforts infant B.

Cushion 14 and sling 16 remain in the arrangement described above with reference to FIG. 1 where peripheral cushion area 14 surrounds central sling area 16. Infant B, however, is now depicted on its stomach, otherwise known as "tummy time" position. When placed on its stomach, a portion of infant B extends over a top of cushion 14 while a remaining portion of infant B is located on top of sling 16. Less weight is centrally located over sling 16 and therefore, sling 16 deforms less than when infant B is placed completely within sling 16. Since infant B extends over cushion 14, cushion 14 also deforms or compresses slightly under infant B. Compression of cushion 14 keeps back of infant B at an angle less than about 45 degrees and therefore, not strained or compressed. Deformation of cushion 14 also keeps infant B close to a surface or floor located beneath pillow 12, which can be less frightening than being elevated at a great distance above a surface.

Figure 3:
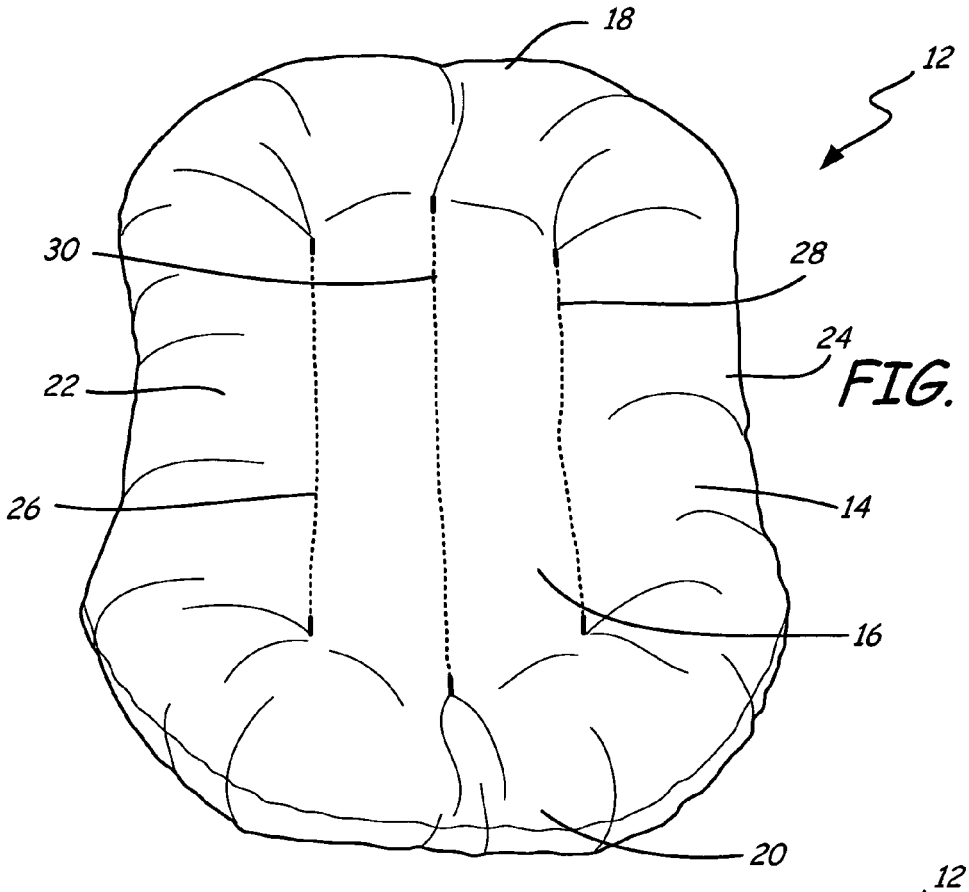
FIG. 3 is a perspective view of the top of a weight activated restraining pillow.

FIG. 3 is a plan view of the top of weight activated restraining pillow 12. Depicted in FIG. 3 are components of pillow 12 as seen from the top: cushion 14, sling 16, top 18, bottom 20, first side 22, second side 24, first seam 26, second seam 26 and third seam 30. Pillow 12 is configured to cradle an infant, child, adult, or non-human animal such as a pet.

Pillow 12 includes peripheral cushion 14 and center sling 16. For descriptive purposes, pillow 12 can be divided into top 18, bottom 20, first side 22 and second side 24. As depicted, first side 22 and second side 24 are substantially parallel to each other yet spaced apart and extending between top 18 and bottom 20. Sling 16 is surrounded by cushion 14 and at least partially defined by first seam 26 extending substantially parallel to first side 22 and second seam 28 extending substantially parallel to second side 24. First seam 26 and second seam 28 separate sling 16 from cushion 14 so that the fill located within cushion 14 does not significantly spread out into sling 16. In the embodiment depicted, no seaming separates top 18 and bottom 20 from sling 16, thereby ensuring that the fill forms a gentle slope between cushion 14 and sling 16 at top 18 and bottom 20. Located in a center of sling, in between and substantially parallel to first seam 26 and second seam 28, is third seam 30. In the depicted embodiment, third seam 30 is slightly longer than first seam 26 and second seam 30, which have similar lengths. In other embodiments, first seam 26, second seam 28, and third seam 30 can have approximately equal lengths.

When a weighted object is placed approximately over third seam 30, first seam 26 and second seam 28 draw inward toward third seam 30. Depending on the size and weight of the object placed in sling 16, first side 22 and second side 24 of cushion 14 can be pulled centrally or horizontally such that they hug, cuddle, or cradle the weighted object located in sling 16. The sensory stimulation provided by contact with cushion 14 can be a source of comfort to fussy and/or premature infants, humans with autism or dementia, and even household pets. Furthermore, the cradling effect or U-shaped nature of sling 16 restricts movement such that objects placed within sling 16 cannot easily turn over or roll out of pillow 12 onto a surrounding surface. The amount of pressure exerted on an object by the sling effect is proportional to the size and weight of the object.

Figure 4:
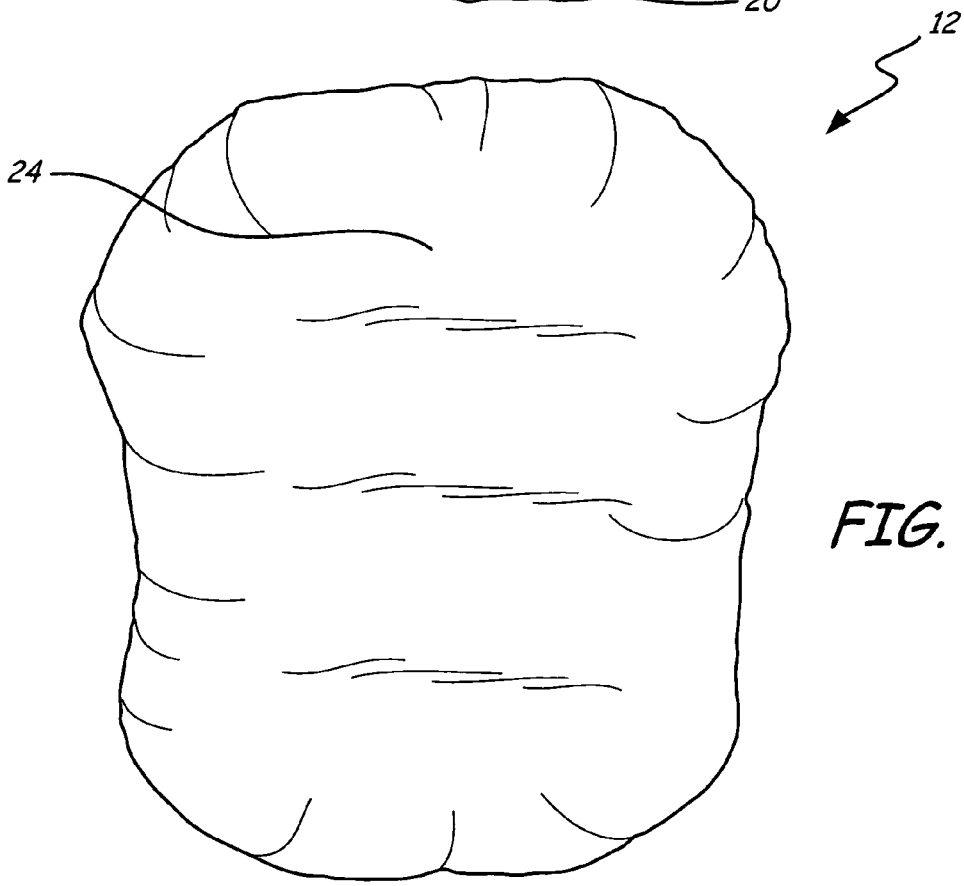
FIG. 4 is a perspective view of the pillow illustrated in FIG. 3 covered with a case.

FIG. 4 is a plan view of weight activated restraining pillow 12 covered with case 24. Case 24 completely surrounds and encloses pillow 12, thereby protecting pillow 12 from spills and stains. Case 24 is easily removed for cleaning. Both pillow 12 and case 24 are washable. Furthermore, case 24 can provide a desired surface texture or design for pillow 12.

Figure 5:
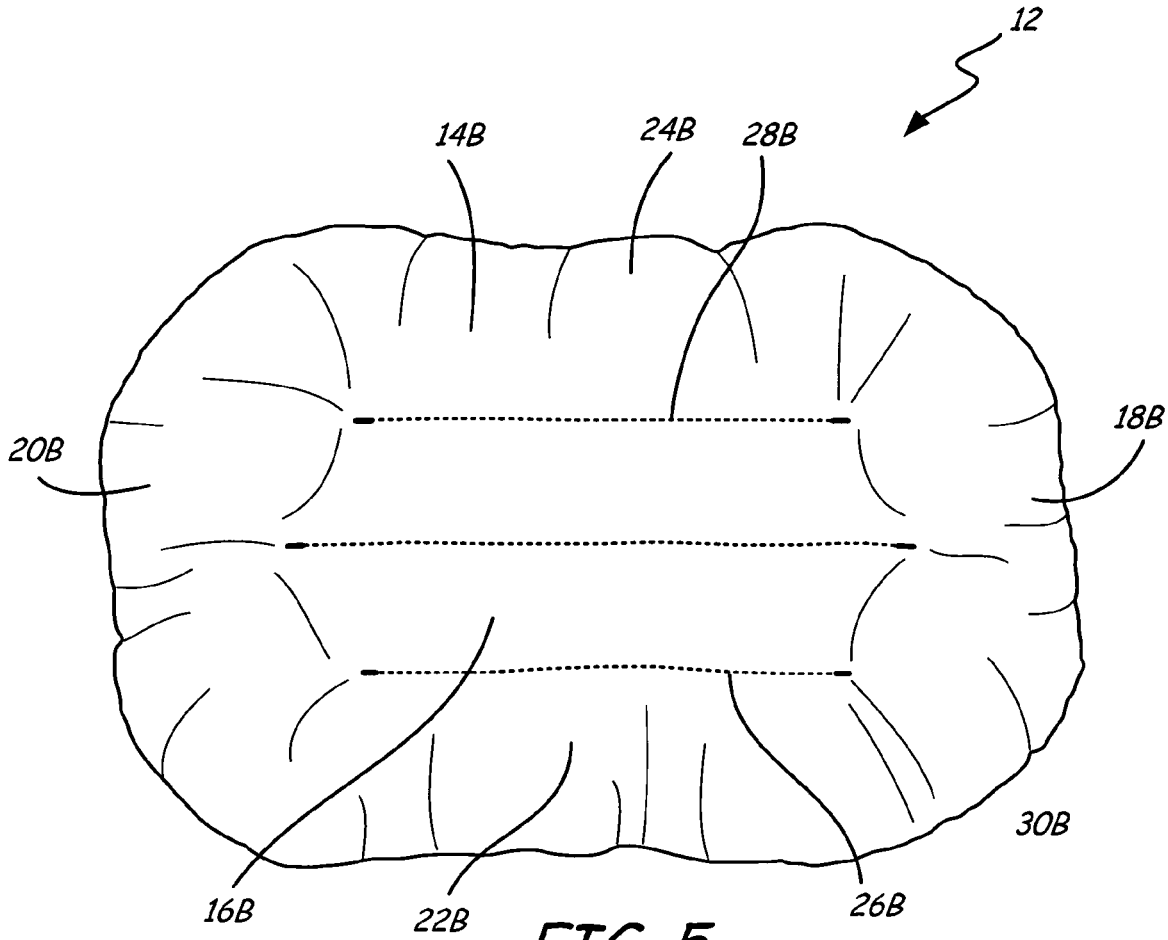
FIG. 5 is a plan view of the bottom of the pillow illustrated in FIG. 3.

FIG. 5 is a plan view of the bottom of weight activated restraining pillow 12. Depicted in FIG. 5 are components of pillow 12 as seen from the bottom: cushion 14B, sling 16B, top 18B, bottom 20B, first side 22B, second side 24B, first seam 26B, second seam 26B and third seam 30B. Pillow 12 is configured to place slight peripheral pressure on an infant, child, adult, or non-human animal such as a pet located on top of pillow 12.

Bottom of pillow 12 is similar to top of pillow 12 and thus, cushion 14B, sling 16B, top 18B, bottom 20B, first side 22B, second side 24B, first seam 26B, second seam 26B and third seam 30B are arranged as described above. Pillow 12 can be constructed from a singular piece of cloth material, or alternately two pieces of material such as a top sheet and bottom sheet that are mirror patterns of one another. The cloth or textile material is stitched to create perimeter cushion area 14 and seams 26, 28 and 30. In the embodiment depicted, first seam 26 and second seam 28 have similar lengths between about 10 inches and about 15 inches, more preferably between about 12 inches and 14 inches. Third seam 30 is longer than first seam 26 and second seam 28. Third seam 30 has a length between about 15 inches and about 20 inches, more preferably between about 16 inches and about 18 inches. A space between third seam 30 and first seam 28, as well as a space between third seam 30 and second seam 26, is between about 2 inches and about 5 inches, more preferably between about 3 inches and 4 inches. A small gap is left to stuff perimeter 14 with appropriate fill. Alternately, fill is placed in position and then the material is stitched to create the desired shape. The construction of pillow 12 is described further below with reference to FIGS. 6-8.

Figure 6:
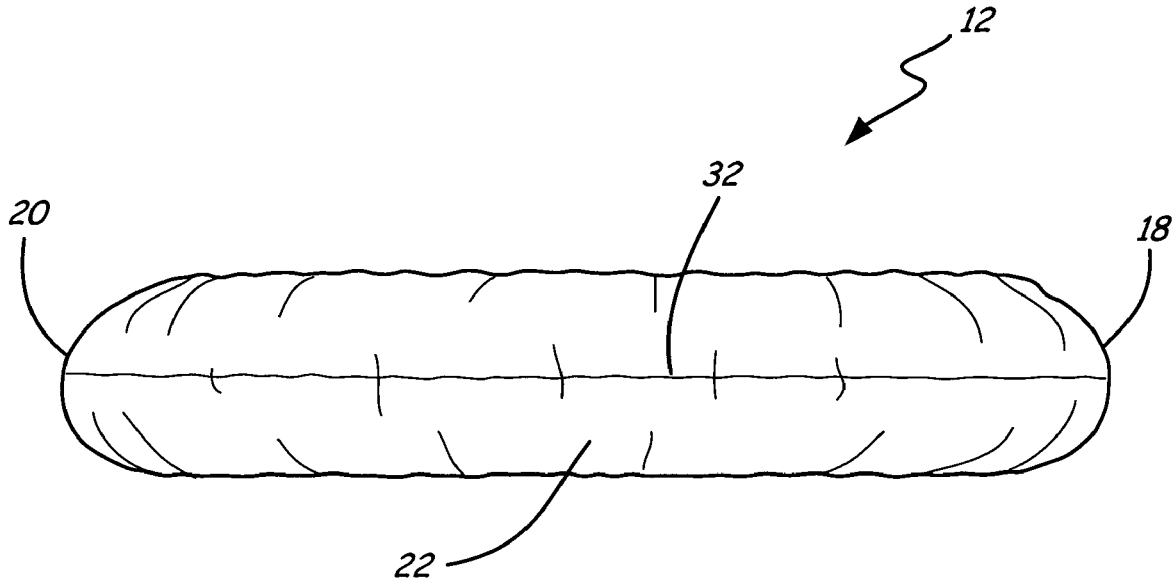
FIG. 6 is an elevation view of a side of the pillow illustrated in FIG. 3.
Figure 7:
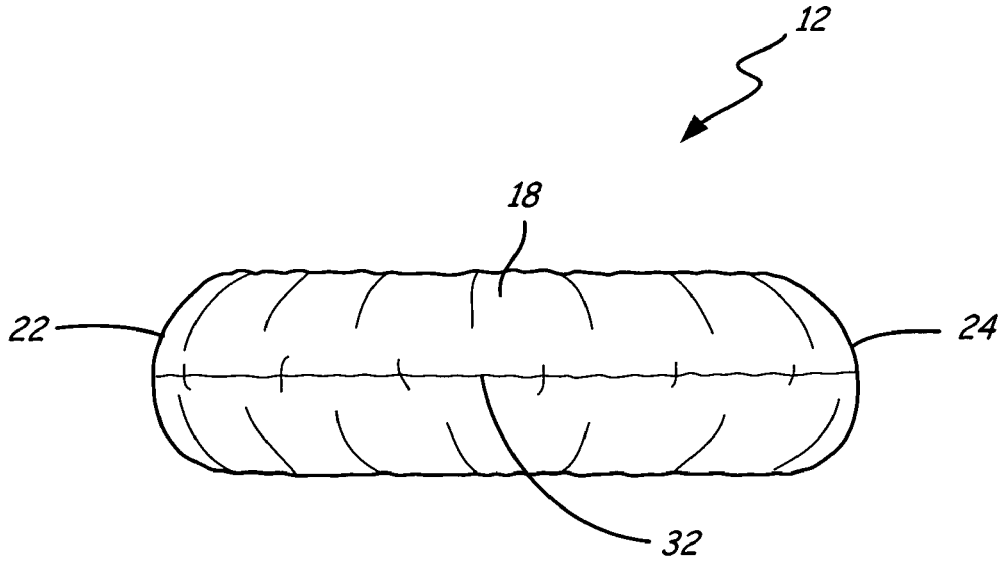
FIG. 7 is an elevation view of an end of the pillow generally perpendicular to the side illustrated in FIG. 6.

FIG. 6 is an elevation view of first side 22 of pillow 12 and FIG. 7 is an elevation view of top 18 of the pillow generally perpendicular to the first side 22. Depicted in FIG. 6 are: pillow 12, top 18, bottom 20, first side 22 and fourth seam 32. Depicted in FIG. 7 are: pillow 12, top 18, first side 22, second side 24 and fourth seam 32. Pillow 12 cradles objects that are placed centrally on a top surface of pillow 12.

Described below are dimensions of pillow 12 preferable for use with infants, although the invention is not so limited. Top 18 and bottom 20 are substantially parallel to each other and have similar lengths between about 15 inches and about 20 inches, more preferably between about 16 inches and about 18 inches. Since top 18 is similar to bottom 20, only top 18 is shown in FIG. 7 although the below discussion relates similarly to bottom 20. First side 22 and second side 24 are substantially parallel to each other and have similar lengths between about 20 inches and about 30 inches, more preferably between about 24 inches and about 28 inches. Since first side 22 is similar to second side 24, only first side 22 is shown in FIG. 6 although the below discussion relates similarly to second side 24. As shown in FIG. 6, fourth seam 32 extends around an approximate center of first side 22 from top 18 to bottom 20. As shown in FIG. 7, fourth seam 32 continues around top 18. In fact, forth seam 32 extends the length of second side 24 from top 18 to bottom 20 and continues around bottom 20, such that fourth seam 32 is continuous around an entire perimeter of pillow 12. Stitching pattern, including fourth seam 32, keeps filling within cushion 14 and out of sling 16. In alternative embodiments, fourth seam 32 is partially or wholly omitted. Fourth seam 32 is substantially parallel to a surface on which pillow 12 is resting and maintains fill within cushion 14. Together, top 18, bottom 20, first side 22 and second side 24 are continuous and defined at the periphery by fourth seam 32, which aids in formation of cushion 14 or the "guard rail" portion of pillow 12.

Figure 8A:
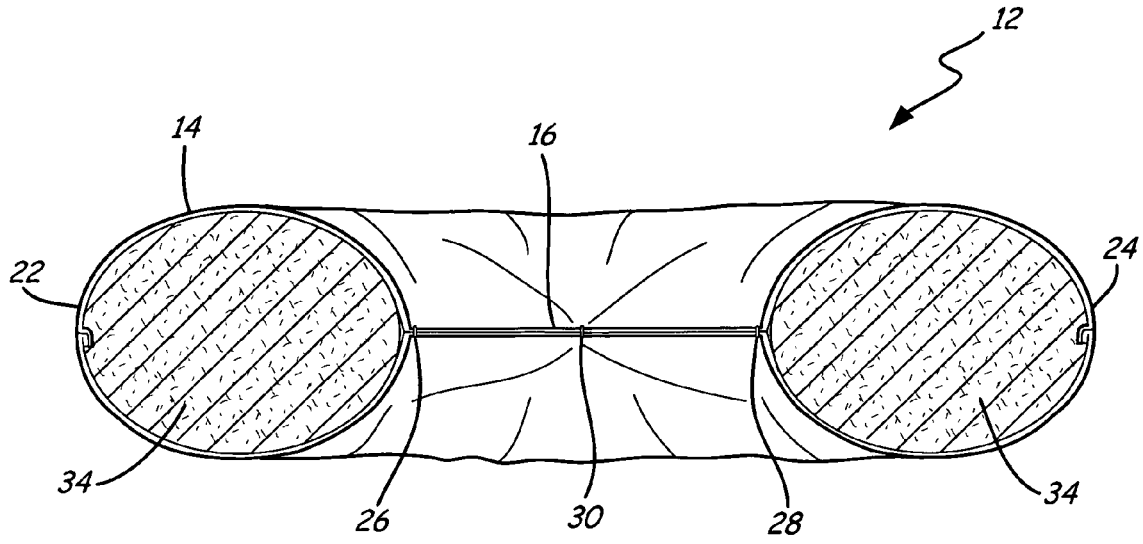
FIGS. 8A and 8B are a cross-sectional views of an alternative embodiment of a weight activated restraining pillow.
Figure 8B:
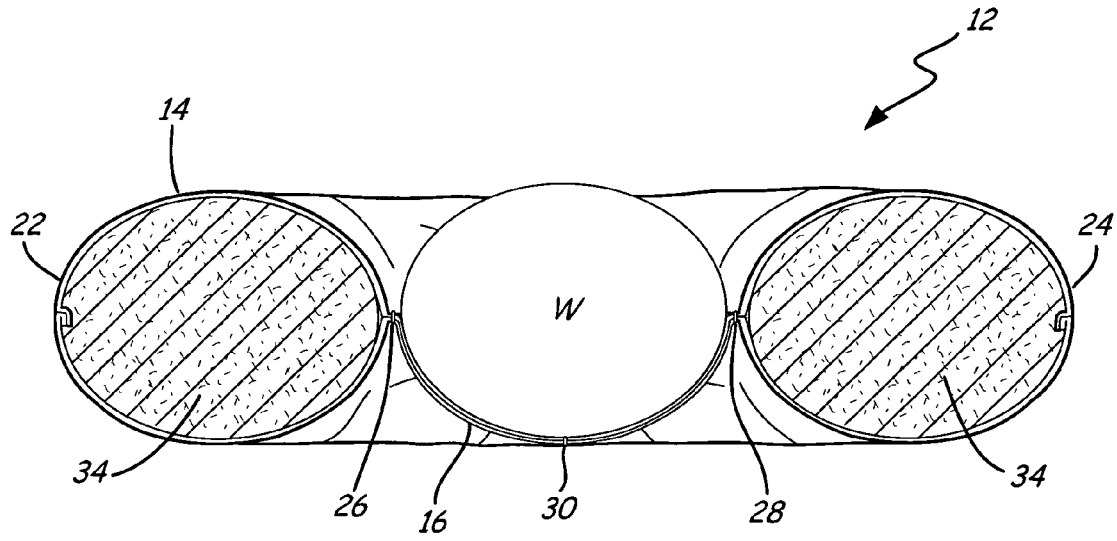

FIG. 8A is a cross section of pillow 12 in an un-weighted position. FIG. 8B is a cross section of pillow 12 in a weight activated position. Depicted in FIGS. 8A and 8B are pillow 12, cushion 14, sling 16, first side 22, second side 24, first seam 26, second seam 28, third seam 30 and fill 34. Additionally depicted in FIG. 8B is weight W.

As described above, pillow 12 includes cushion region 14 surrounding sling region 16. Cushion 14 is stuffed with fill 34 and is approximately circular in cross section. When pillow 12 is sized for use with infant B, the following dimensions are preferable, although the invention is not so limited and pillow 12 can be sized differently depending on intended use. Cushion 14 can have a diameter between about 3 inches and about 6 inches, more preferably between about 4 inches and about 5 inches. In contrast, sling 16 is not stuffed and is substantially flat. In FIG. 8A, sling 16 is un-weighted and suspended above a surface on which cushion 14 is resting. Without weight activation from weight W, sling 16 is between about 1 inch and about 4 inches above a surface, more preferably between about 2 inches and about 3 inches. In FIG. 8B, sling is weighted by weight W, and since weight W is sufficient to deform sling 16 into contact with a surface upon which cushion 14 is resting, there is no longer any vertical distance between sling 16 and the surface. The amount which sling 16 is deformed toward the surface is proportional to the size and weight of weight W.

When weight W is placed into and deforming sling 16, cushion 14 moves centrally or horizontally inwards toward weight W. Usually, weight W is centrally located approximately over third seam 30 such that first seam 26 and second seam 28 place approximately equal tension on first side 22 and second side 24, respectively. Sling 16 dips in the center when weighted by weight W such that it forms a U-shape. The vertical location of an intersection between first seam 26 and first side 22, as well as the vertical location of an intersection between second seam 28 and second side 24, are essentially unchanged between FIG. 8A and FIG. 8B. Maintaining vertical location of first seam 26 and second seam 28 regardless of weight activation ensures that cushion 14 is not moving vertically and therefore, not smothering weight W. The distance that is changed between FIGS. 8A and 8B, however, is the horizontal distance between first side 22 and second side 24. In FIG. 8A, the horizontal distance between first seam 26 and second seam 28 is between about 5 and about 10 inches, more preferably between about 6 and about 8 inches. In contrast, FIG. 8B shows a substantially reduced horizontal distance between first seam 26 and second seam, which is between about 2 inches and about 8 inches, more preferably between about 4 inches and about 6 inches. Thus, weight W causes sling 16 to deform downwardly toward a surface on which cushion 14 is resting, thereby bringing first side 22 and second side 24 horizontally closer to one another. Lowering of sling 16 and inward movement of cushion 14 produces a sensory stimulus similar to cuddling, snuggling, or cradling within sling 16.

Pillow 12 can be sized to cradle anyone from a premature infant to a full-sized adult. Furthermore, pillow 12 can be configured to provide the same sensory stimulation to non-human animals such as, but not limited, household pets. Although the present invention has been described with reference to preferred embodiments, workers skilled in the art will recognize that changes may be made in form and detail without departing from the spirit and scope of the invention.

The invention claimed is:

1. A weight activated restraining pillow comprising:

a cushion having a padded region and an unpadded region, the padded region generally surrounding the unpadded region;

a first longitudinal seam defining a first side of the unpadded region, a second longitudinal seam defining a second side of the unpadded region, and a third longitudinal seam located centrally within the unpadded region, wherein the third longitudinal seam is spaced approximately halfway between, and extends parallel to, both the first longitudinal seam and the second longitudinal seam, and the third longitudinal seam is longer than the first longitudinal seam and the second longitudinal seam, wherein a weighted object placed centrally within the unpadded region draws the first longitudinal seam and second longitudinal seam inwards toward one another.

2. The weight activated restraining pillow of claim 1, wherein the unpadded region has a curved bottom contour between the first longitudinal seam and the second longitudinal seam.

3. A weight activated restraining pillow comprising:

a peripheral cushion area including a top, a bottom, a first side and a second side, wherein the first side and the second side are substantially parallel and extend between the top and the bottom;

fill material located within the peripheral cushion area;

a central sling holding area located inside of the peripheral cushion area and devoid of the fill material, the central sling holding area defined in part by a first seam extending substantially parallel to the first side and a second seam extending substantially parallel to the second side, a third seam located centrally within the sling approximately halfway between, and extending substantially parallel to, both the first seam and the second seam, the third seam is longer than the first seam and the second seam, wherein the first seam and the second seam separate the sling from the cushion so that when a weighted object is received into the sling, the first side and the second side of the cushion area draw inward toward the weighted object within the sling.

4. The weight activated restraining pillow of claim 3, wherein the first seam and the second seam have approximately equal lengths.

5. The weight activated restraining pillow of claim 3, further comprising:

a fourth seam located along an outer surface of the peripheral cushion area.

6. The weight activated restraining pillow of claim 5, wherein the fourth seam extends around the top, the first side, the bottom and the second side such that it is continuous around the outer surface of the peripheral cushion area.

7. The weight activated restraining pillow of claim 3, further comprising:

a removable case covering the pillow.

8. The weight activated restraining pillow of claim 3, wherein the cushion is oval shaped.

9. The weight activated restraining pillow of claim 3, wherein a bottom surface of the sling has a concave contour between the first seam and the second seam.

10. The weight activated restraining pillow of claim 9, wherein the cushion deforms to keep the weighted object at an angle of less than about 45 degrees.

11. The weight activated restraining pillow of claim 10, wherein the cushion extends outwardly and upwardly from both the first seam and the second seam to form a curved bumper around the sling.

12. The weight activated restraining pillow of claim 11, wherein the curved bumper bends slightly inwards in response to a weighted objected being placed into the sling.

13. A weight activated restraining pillow comprising:

a cushion having a padded region and an unpadded region, the padded region generally surrounding the unpadded region;

a first longitudinal seam defining a first side of the unpadded region and a second longitudinal seam defining a second side of the unpadded region, the unpadded region has a curved bottom contour between the first longitudinal seam and the second longitudinal seam, a third longitudinal seam located centrally within the unpadded region, the third longitudinal seam is spaced approximately halfway between, and extends parallel to, both the first longitudinal seam and the second longitudinal seam, and the third longitudinal seam is longer than the first longitudinal seam and the second longitudinal seam, wherein a weighted object placed centrally within the unpadded region draws the first longitudinal seam and second longitudinal seam inwards toward one another, wherein the weighted object has a spinal column aligned by receipt into the unpadded region.

14. The weight activated restraining pillow of claim 13, wherein the padded region extends outwardly and upwardly from both the first longitudinal seam and the second longitudinal seam to form a curved bumper around the unpadded region.

15. The weight activated restraining pillow of claim 14, wherein the curved bumper bends slightly inwards in response to a weighted objected being placed into the unpadded region.

16. The weight activated restraining pillow of claim 15, wherein the padded region has a length of about 20-30 inches, a width of about 12-22 inches and a depth of about 1-10 inches.

* * * * *